United States Patent [19]

Sepp et al.

[11] 4,398,466

[45] Aug. 16, 1983

[54] METHOD AND APPARATUS FOR AVOIDING AN UNDESIRED FIRING OF A WEAPON

[75] Inventors: Gunther Sepp, Ottobrunn; Christian Diehl, Gruenwald; Richard Bogenberger, Wolfratshausen; Gunthard Born, Munich; Friedbert Mohr, Zorneding; Roland Schmidt, Groebenzell; Werner Schnaebele, Wolfratshausen; Korbinian Thalmair, Freising, all of Fed. Rep. of Germany

[73] Assignee: Messerschmitt-Boelkow-Blohm GmbH, Munich, Fed. Rep. of Germany

[21] Appl. No.: 264,415

[22] Filed: May 18, 1981

[30] Foreign Application Priority Data

May 23, 1980 [DE] Fed. Rep. of Germany ..... 3019783

[51] Int. Cl.[3] ..... F42B 23/26; F42C 13/00

[52] U.S. Cl. ..... 102/427; 102/211

[58] Field of Search ..... 102/427, 211, 213

[56] References Cited

U.S. PATENT DOCUMENTS 3,304,864 2/1967 Thomanek ..... 102/427

3,509,791 5/1970 Pechamat et al. ..... 102/427

*Primary Examiner*—Charles T. Jordan

*Attorney, Agent, or Firm*—W. G. Fasse; D. H. Kane, Jr.

[57] ABSTRACT

A system for automatically firing or discharing a weapon, such as a mine, comprises acoustical sensors for the preliminary adjustment and firing of the weapon. An optical sensor is used in conjunction with the acoustical sensors. In a first step, prior to the first acoustical target acquisition, the target background is optically scanned to store first optical image values defining an optical image of the target background to determine a firing range and a firing horizon. Thereafter, an acoustical ranging is performed for the target acquisition. Then the optical scanning and storing is repeated with regard to a firing horizon and when a target approaches the firing horizon, to provide second optical image values which are compared with the first image values to provide, by signal differentiation, proof of the presence of a target at the firing horizon. The resulting signal is used to control the weapon. The steps of optical scanning, signal storing, and comparing may be repeated for a target zone, which is larger than the target, whereby a target profile or silhouette is produced. The respective electrical signal is used for the fine adjustment of the weapon prior to firing by the target presence signal.

9 Claims, 3 Drawing Figures

METHOD AND APPARATUS FOR AVOIDING AN UNDESIRED FIRING OF A WEAPON

CROSS-REFERENCE TO RELATED APPLICATIONS

The present application is based on German Ser. No. P 3,019,783.2 filed in the Federal Republic of Germany on May 23, 1980. The priority of the German filing date is claimed for the present application.

BACKGROUND OF THE INVENTION

The present invention relates to a method and apparatus for avoiding an undesired firing of a weapon, for example an automatically responsive mine which may be effective over a wide range and which may be preadjusted by means of acoustical sensors, or which may be fired toward a target in the form of a so-called load.

Such devices are known in various prior art forms or modifications. However, it is a common drawback of all prior art systems that failures cannot altogether be avoided. A failure may be due, for example, to the fact that the effective reach of a projectile has been exceeded when the projectile is fired in an acoustically preaimed direction. Besides, in the prior art devices the acoustical aiming or direction finding is relatively rather inaccurate.

OBJECTS OF THE INVENTION

In view of the above it is the aim of the invention to achieve the following objects singly or in combination:

to provide a method and apparatus for reliably avoiding the above mentioned disadvantages of the prior art;

to combine an optical scanning by means of a laser range measuring device with an arrangement for an acoustic direction finding to thereby substantially improve the accuracy of the weapons system;

to avoid the firing of a projectile onto a target which is outside the firing reach of the projectile, whereby the firing reach of the projectile in all possible directions defines the firing range;

to provide especially a defensive weapons system which is autonomous in itself and especially suitable for use against relatively slow moving ground and air targets such as tanks, trucks, helicopters and so forth; and to produce as the result of an optical range measurement and of an optical angular or direction measurement firing control signals in such a manner that the range measurement and the direction finding are utilized for producing a super elevation value and a reach value for controlling and directing the firing of a projectile, for example a hollow load, onto a target.

SUMMARY OF THE INVENTION

According to the invention there is provided a method and apparatus for avoiding failures in the firing of automatic weapons such as automatically operating long range mines which are preadjusted by means of acoustical sensors. Even before the first acoustical target acquisition or pick up, the space within the field of fire of the weapon is scanned by optical range and angular direction finding means. This scanned space defines the target background. The scanned signals are stored in a memory, whereby all image points within the firing reach form the so-called firing range as defined above. The line of demarkation between the firing range and all other image points defines the firing horizon. After the optical scanning and signal storing, the acoustical target acquisition is performed. Thereafter, the optical scanning is performed again when a target approaches the firing horizon in a target zone or area determined by the acoustical direction finding. The resulting signals of the second optical scanning are also stored for a subsequent signal comparing whereby a difference is formed between signals representing old and new image points. The old image points define the background and the new image points define an expected target, whereby the comparing or difference formation provides a signal constituting proof of the presence of a target at the firing horizon. The resulting signal is then used for the fine adjustment and firing of the projectile.

If desired, a further acoustical scanning and signal storing may be performed for a larger zone around the target whereupon again the resulting signals are compared to form a difference signal for defining a target silhouette. The target silhouette signal is used for a fine sighting of the weapon and the signal representing the presence of a target is used for firing the so adjusted or fine sighted weapon.

The apparatus according to the invention comprises for example four acoustical sensors arranged at the corners of a tetrahedral. These acoustical sensors cooperate with a central computer which forms an evaluation and control unit and which further cooperates with an active optical range and direction measuring device comprising a laser beam deflection device and an image storing memory for each image or image point scanned in the target direction, whereby all image point outside of the firing reach define the firing horizon and whereby the target silhouette is formed from signals representing image points within the firing reach.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
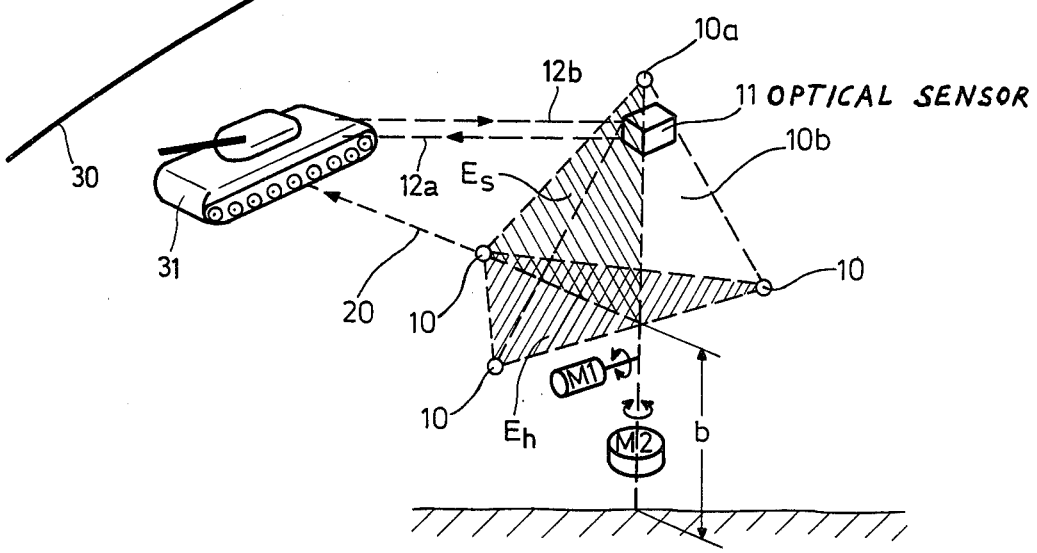
FIG. 1 is a perspective, schematic illustration of the present system comprising optical and acoustical sensors arranged according to the invention.

As shown in FIG. 1, a set of three acoustical sensors 10 is located at a predetermined spacing "b" above the ground, for example on a tower not shown. The set of three acoustical sensors 10 define a plane Eh which is horizontally oriented. The length of the distance "b" will depend on the type of the particular weapons system. The connecting lines between the three sensors 10 form an isosceles triangle. Advantageously, at least one of the sensors 10 should be located in the line of sight 20 which corresponds to the firing line. A fourth acoustical sensor 10*a* is located above the horizontal plane Eh so that all four sensors form a tetrahedron 10*b* bounded in FIG. 1 by the dashed lines.

According to the invention an optical sensor 11 is arranged close to the top of the tetrahedron 10*b* as shown. The optical sensor 11 is in the form of an active optical distance and direction or angular measuring device which operates by means of a laser beam deflection system and an image storing memory. The optical sensor 11 transmits a laser light beam 12*a* toward the firing horizon 30 and thus toward the target 31. A returned scattered light portion 12*b* is received by the receiver portion of the sensor 11.

Prior to the acoustical target acquisition by the acoustical sensors 10, 10*a*, the optical sensor 11 scans, under the control of the motors M1 and M2, the field of fire of the weapon and the resulting electrical image signals are stored in a memory. All electrical signals define a target background image. The image points within the firing reach define the firing range and a line between the firing range and all other image points defines the firing horizon 30. The firing reach in this context is considered to be the effective range of the weapon in a specific direction measured as a distance, whereas the firing range is defined by said distance in all directions. After the first optical ranging or rather scanning the acoustical target acquisition is performed. If now a target approaches the firing horizon, the latter is again optically scanned within the vicinity of the acoustically acquired target zone. The resulting electrical signals are again stored for a comparing with the previously acquired and stored electrical signals, whereby the comparing of the signals is a signal differentiation resulting in a signal proving the presence of a target 31 near the firing horizon 30. This signal which proves the presence of a target may already be used for generating a weapon control firing signal.

However, according to a modification of the invention the present method may be expanded by performing yet a further optical scanning of a larger target zone, whereby again the resulting signals are differentiated in order to form a target silhouette image or a respective silhouette signal. The silhouette signal is used for a fine adjustment or fine sighting of the weapon and the signal indicating the presence of a target is used for firing the weapon. Stated differently, according to the invention it is possible to perform an optical direction finding by means of a laser beam deflection device of the optical sensor 11 and by means of a controlled image memory in which the image point signals are stored in such a manner that all image points outside the firing range are provided with a respective characterizing mark or flag. Similarly, all image points within the firing range are also provided with a different flag. After the acoustical target acquisition the so-called firing horizon 30 is preferably scanned by the optical sensor 11. If now a target 31 enters into the firing range, the particular partial zone of the stored images is specifically scanned to form the target silhouette which may be used for a fine adjustment of the weapon sighting or for the weapon firing.

It has been found that the time necessary for performing the present method may be substantially reduced in that prior to the first acoustical target acquisition only a portion of the firing field is scanned by the optical means. This portion is preferably the environment of the firing horizon. This simplification may be accomplished, for example, in that one starts with an image point in the firing range. With reference to this point the elevation of the laser beam is continuously increased while simultaneously measuring the distance until the firing horizon is reached. The horizon may then be further tracked or scanned by known tracking methods.

Under certain circumstances it may be sufficient to only perform two optical scannings, one prior to the acoustical target acquisition and one after the acoustical target acquisition, whereby subsequent to the second optical scanning of the firing horizon the result of the signal differentiation is used for the fine sighting of the weapon and also for producing the firing signal. A double optical scanning way, for example, be sufficient when the type of target is known ahead of time, for example that a tank 31 is approaching so that it is merely necessary to detect whether the target is actually within the firing horizon and thus within the weapon's reach. This use of but two optical measuring or scanning steps may also be advantageous when the resulting reduction in the measuring time is more important than the increase of the reliability in the target identification.

Under certain circumstances in which the short duration of the measuring time is most important and in which the formation of a target identification by providing a target silhouette image is unnecessary, for example because the type of target is known, it is advantageous to measure but one target point. The position of this one target point is optically determined after the acoustical target acquisition. In this operating mode the central computer in the evaluation and control unit 17 first precalculates a suitable firing line or firing direction on the basis of the acoustical tracking of the moving direction and speed of the target 31. Further, the optical scanning performs a distance measurement for this firing direction even prior to the actual appearance of the target. Stated differently, the distance is measured to a point at which the target is expected to later appear. If there are no obstacles in the so determined firing direction, that is, if the field of fire is free, a second distance measurement is performed at precisely that point of time in which the expected target 31 has reached the target point in accordance with the acoustically determined values of this target point. If the target distance now is within the firing reach, the firing is automatically accomplished. In this situation the computer in the unit 17 takes into account the lead allowance, super-elevation, and so forth so that the actual firing direction may deviate from the firing direction of the distance measuring device in a precalculated manner.

Figure 2:
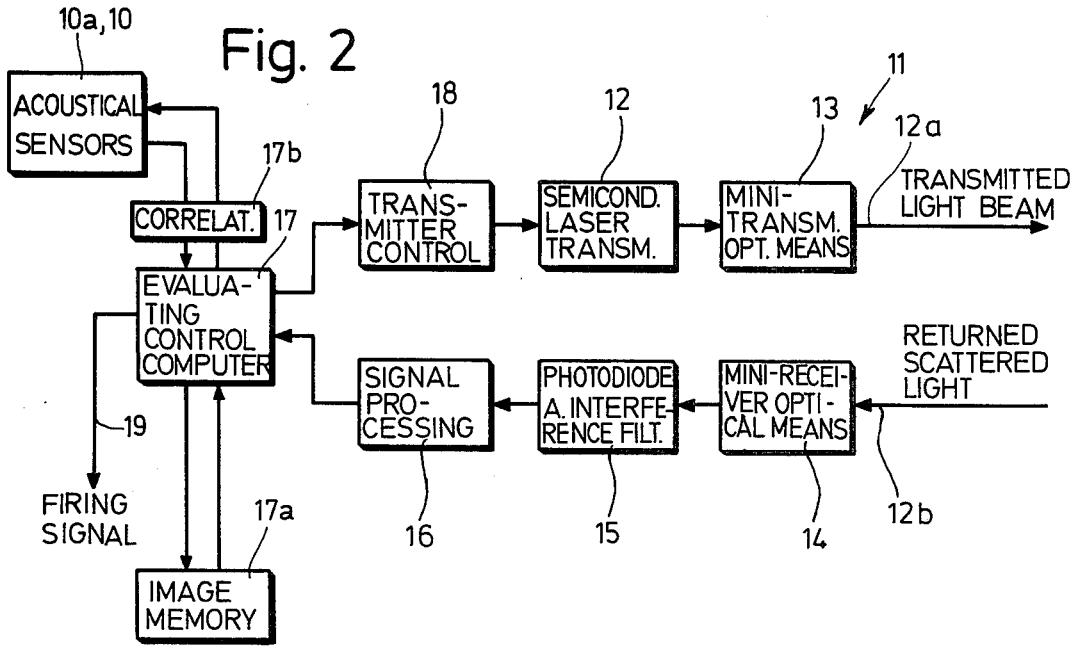
FIG. 2 is a block diagram of a circuit arrangement according to the invention connecting the acoustical and optical sensors to an evaluating control central computer.
Figure 3:
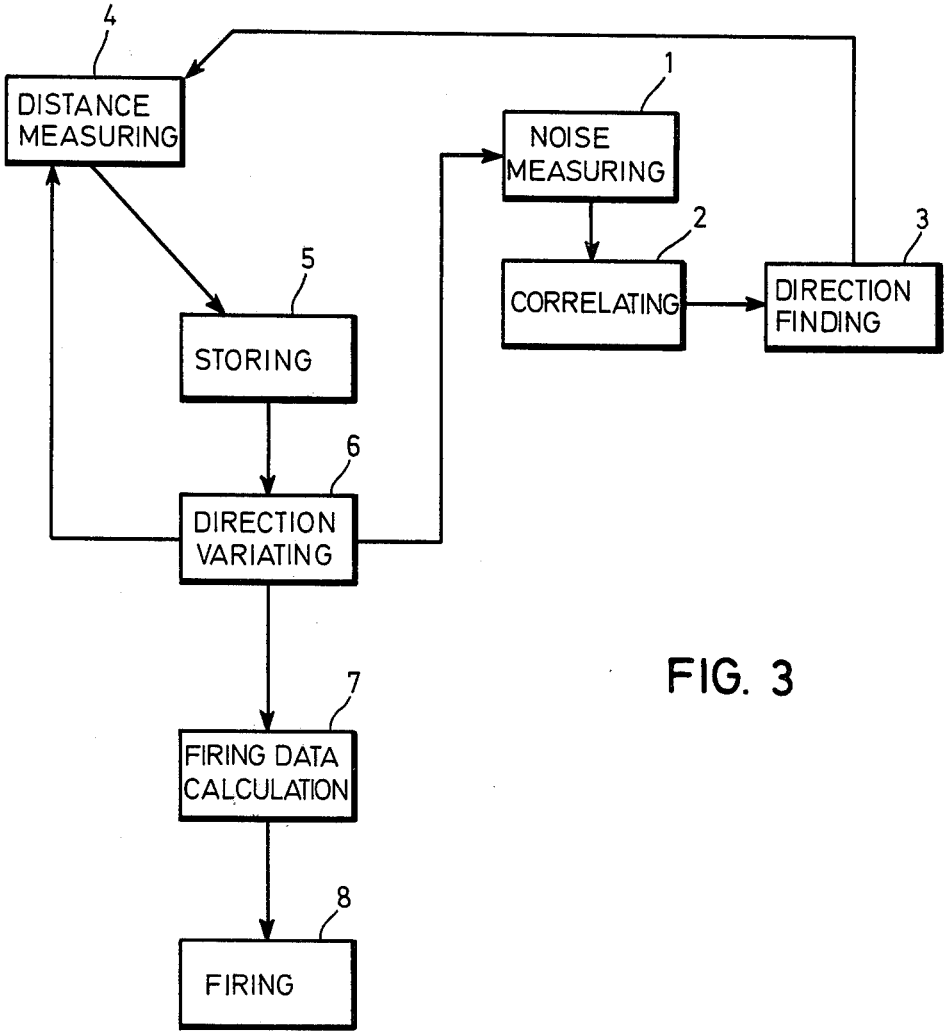
FIG. 3 is a flow diagram of the program steps of the central computer.

FIG. 2 shows the block circuit diagram according to the invention. The sensors 10 and 10*a* are operatively connected to the evaluation and control unit 17 comprising a central computer. The output of the control unit 17 is connected to a transmitter control circuit 18 which operates the semiconductor laser transmitter 12. When the laser transmitter 12 is activated, the transmitted laser light beam 12*a* is directed through a miniature transmitter optical means 13 onto the target area. The target area is defined in a rough manner by the acoustical sensors 10, 10*a*. Simultaneously the optical sensor 11 or rather its beam deflection device, is caused to perform the required scanning movement. The returned scattered light 12*b* which is delayed relative to the transmitted laser light beam 12*a*, is received in a miniature optical receiver means 14 supplying the light onto a photodiode and interference filter 15 which in turn supplies the resulting electrical signal to a signal processing unit, the output of which is connected to the central evaluating control computer unit 17 operating in accordance with the program steps shown in FIG. 3. When the optimal point of time and the optimal target position are achieved, the unit 17 produces a firing signal at its output 19 for controlling or adjusting the weapon. By using miniaturized electronic components it is possible to provide a compact, lightweight, yet very precise and reliable ranging and direction finding sensor which also operates very rapidly.

Although the invention has been described with reference to specific example embodiments, it will be appreciated, that it is intended, to cover all modifications and equivalents within the scope of the appended claims.

The term "field of fire" is to be understood as meaning the space which may be covered by a weapon. The target background image includes the topography such as hills, trees, even including clouds and the sky against which a target is located.

The term "firing reach" is a distance at which a target may be attached by a weapon with a sufficient target hitting probability.

The term "firing range" encompasses a circular surface around a weapon having a radius corresponding to the firing reach. The "firing horizon" is the circumference of the firing range circle as viewed from a weapon.

The term "target vicinity" is the space directly at a target. The vicinity of the "firing horizon" is the space directly at the circle defining the firing range. The term "target silhouette" defines the contour of the target as seen from the location of the weapon. The term "background" in this context means the space which may be seen from the location of a weapon in the area of the firing horizon, including woods, meadow or clouds.

Two motors M1 and M2 serve as deflecting device for the laser beam. These motors move or rotate the entire weapon horizontally or vertically.

The acoustic sensors 10, 10*a* are connected to the central computer 17 through a correlator 17*b* which is a known measured value recorder and comparator.

The structural components shown in FIG. 2 are known as such and freely available in the market place. The elements 12, 13, 14, 15, 16 and 18 form a conventional laser distance measuring device which is arranged for cooperation with the acoustical sensors 10, 10*a*, with the correlator 17*b*, with the control unit or computer 17 and with the image memory 17*a*.

What is claimed is:

1. A method of using acoustical ranging means and optical ranging means in conjunction for avoiding an undesired firing of a weapon, such as a mine, comprising the following steps:

(a) first optically scanning the field of fire of the weapon to provide first electrical signals which define a target background image whereby all image points within the firing reach define the firing range and whereby a line between the firing range and all other image points defines the firing horizon, (b) storing said first electrical signals in a memory, (c) performing an acoustical target acquisition within a target zone, (d) optically scanning the firing horizon when a target approaches the firing horizon to provide second electrical signals which may prove the presence of a target at the firing horizon, (e) storing said second electrical signals, (f) comparing the first and second electrical signals to provide difference electrical signals for providing a proof signal of the presence of a target at the firing horizon, and (g) using said proof signal for a fine adjustment and for firing a weapon.

2. The method of claim 1, further comprising the steps of repeating said optical scanning, signal storing and comparing steps for a given zone around the target to provide a target silhouette signal, and using said silhouette signal and said proof signal respectively for a fine adjustment and for firing or detonating a weapon.

3. The method of claim 1 or 2, wherein said first optical scanning step prior to said acoustical target acquisition is performed for a portion of the field of fire.

4. The method of claim 3, wherein said portion of the field of fire is the vicinity of the firing horizon.

5. The method of claim 1, wherein in said step (a) only a single image point of said field of fire is optically scanned, and wherein the location of said single image point is determined after said acoustical target acquisition.

6. An apparatus for using acoustical ranging means and optical ranging means in conjunction for avoiding an undesired firing of a weapon, comprising first acoustical ranging means, second optical ranging means, central evaluating and control computer means operatively connected to said first and second ranging means, said second ranging means comprising laser beam transmitter means, scattered laser light receiver means, and signal processing means operatively connected to said light receiver means for processing scanned images, whereby signals representing image points outside a firing reach define a firing horizon, whereas signals representing image points within the firing reach are used to define a target silhouette.

7. The apparatus of claim 6, wherein said laser beam transmitter means comprise a semiconductor laser with miniaturized laser transmitter optical means, and wherein said scattered laser light receiver means also comprise miniaturized optical receiver means.

8. The apparatus of claim 6, wherein said first acoustical ranging means comprise four acoustical sensors arranged at the corners of a tetrahedron for providing acoustical ranging signals to said central computer means, and wherein said second optical ranging means comprise distance and direction measuring means located near the tip of said tetrahedron.

9. The apparatus of claim 6, wherein said central evaluating and control computer means control the light emission of said laser beam transmitter means and also receive signals from said signal processing means for evaluation to produce weapon control signals.

* * * * *